US007806405B2

(12) United States Patent
Crompton

(10) Patent No.: US 7,806,405 B2
(45) Date of Patent: Oct. 5, 2010

(54) GAMES MACHINE

(75) Inventor: Gordon Crompton, Broadstairs (GB)

(73) Assignee: Game Concepts Ltd. (GB)

( * ) Notice: Subject to any disclaimer, the term of this patent is extended or adjusted under 35 U.S.C. 154(b) by 125 days.

(21) Appl. No.: 12/280,240

(22) PCT Filed: Feb. 22, 2007

(86) PCT No.: PCT/GB2007/000616

§ 371 (c)(1),
(2), (4) Date: Nov. 6, 2008

(87) PCT Pub. No.: WO2007/096625

PCT Pub. Date: Aug. 30, 2007

(65) Prior Publication Data

US 2009/0322022 A1 Dec. 31, 2009

(30) Foreign Application Priority Data

Feb. 23, 2006 (GB) ..... 0603669.3
Jun. 19, 2006 (GB) ..... 0612122.2

(51) Int. Cl.
*A63F 7/02* (2006.01)

(52) U.S. Cl. ..... 273/121 B

(58) Field of Classification Search ..... 273/108, 273/118 A, 119 A, 120 A, 121 A, 121 B, 273/122 A, 123 A, 124 A, 125 A, 127 R
See application file for complete search history.

(56) References Cited

U.S. PATENT DOCUMENTS

| | | | | |
|---|---|---|---|---|
| 5,951,009 | A | 9/1999 | Miyamoto | |
| 2005/0093227 | A1 * | 5/2005 | Sines | 273/121 B |
| 2006/0249896 | A1 * | 11/2006 | Yamazaki et al. | 273/120 A |
| 2009/0322022 | A1 * | 12/2009 | Crompton | 273/121 B |

FOREIGN PATENT DOCUMENTS

| | | | |
|---|---|---|---|
| EP | 1260928 | A2 | 11/2002 |
| JP | 04002381 | A * | 1/1992 |
| JP | 05184721 | A * | 7/1993 |
| JP | 2005066210 | A | 3/2005 |
| WO | WO-02/70836 | A1 | 1/2002 |

* cited by examiner

*Primary Examiner*—Raleigh W. Chiu
(74) *Attorney, Agent, or Firm*—Barnes & Thornburg LLP

(57) ABSTRACT

A games machine (1) includes a video display screen (10) with a transparent front screen (10) in front and a token passage (14) between display screen and front screen. Tokens or coins may be introduced through one or more token inlets (50, 52) at the top of the token passage and the tokens fall under gravity through the token passage bouncing off a plurality of pins (16). The games machine is arranged to display one or more targets on the video display screen, the targets moving over time, and to record a hit when a token hits a pin or other target area at the time a target is displayed on the screen directly behind the pin or target area.

14 Claims, 8 Drawing Sheets

GAMES MACHINE

The invention relates to a games machine, and in particular to a games machine of the type where a coin or token is introduced at the top of a playing surface and falls downwards, deflected by one or more pins so that the path the token takes is determined at least partially by chance.

Note that in this specification the term "token" is used to refer both special tokens of no intrinsic value as well as to coins that may be generally used. Local law generally determines whether tokens or coins should be used in games machines.

There exist prior art games machines in which tokens fall down a slanting or vertical face and are deflected by pins. In older games machine of this type, there is no variable display of any kind.

U.S. Pat. No. 5,951,009 describes a games machine of this type with a display at the rear of the face behind the falling tokens.

Another type of games machine is the Pachinko games machine which is very popular in Japan. Balls are propelled onto a face and again are deflected by pins.

JP 2005-66210 describes a Pachinko games machine with an LCD display behind the pin face. The pins have shock sensors which detect the impact of a ball on the pin, and when a ball hits a pin a collision image is displayed on the display immediately behind the pin to indicate this.

A further type of games machine is the "pusher" machine. In such machines, tokens are inserted and land on a playfield. A reciprocating "pusher" moves backwards and forwards over the play field, pushing the tokens. Tokens may fall over the edge of the play field into a win chute which delivers the falling tokens to the player. The player aims to insert tokens at a time and in such a way as to maximise the tokens falling into the win chute. Generally, small lose chutes are also provided. Tokens falling into the lose chutes are collected by the operator as the winning percentage.

However, games machines are a competitive field and there is a continued desire for improved games machines that provide an enhanced playing experience and are considered more "fun" by users.

According to a first aspect of the invention, there is provided a games machine according to claim 1. According to a second aspect of the invention, there is provided a games machine according to claim 13. Optional features are presented in the sub-claims. For brevity, not all optional features are presented as features of the second aspect as claims dependent on claim 13 although features of claims dependent on claim 1 may also be used in a games machine according to the second aspect.

By providing a continuous video display behind the pins, the games machine according to the invention can provide a greatly enhanced playing experience. The player experiences moving targets displayed by the video. The targets are not only located at the pins, but the player can see a target moving towards a particular pin and aim to introduce a coin at the right moment to win.

In contrast, in the prior art Pachinko games machine of JP2005-66210 all that is displayed is an indication that a pin is hit, at the pin. Not merely does the screen not display targets, it does not display anything at all that smoothly moves over the screen. The hit indications are displayed only at the pins, i.e. at discrete locations corresponding to the pins. Similarly, although U.S. Pat. No. 5,951,009 does describe moving objects behind the pins, these are not targets at all and do not link into the gameplay at all.

The games machine is also extremely flexible and entirely different scenarios may be presented to the player merely by reprogramming the games machine.

Preferably, a contiguous display screen is arranged behind all of the plurality of pins in the token passage. In this way, the targets can move smoothly about the screen behind and between the pins. The screen may be a single screen or made up of a number of sub-elements.

In embodiments, the pins depend rearwardly from the transparent front screen. A conductive grid pattern may be provided on the transparent front screen to connect to the pins or sensors.

Embodiments include a token entry for inputting tokens into the games machine and a pay cup for paying out one or more tokens in the event of a hit.

There may be a plurality of token inlets at the top of the token passage and a means for selecting through which token inlet a token is introduced into the token passage.

Embodiments include a game controller arranged to drive the video display screen with changing images including the one or more targets, to receive signals from the pins indicating when the pins have been hit, and to register a hit when a token hits a pin at the time a target is displayed on the screen directly behind the pin.

Targets may have a simple value and pay out that value when hit.

Alternatively or additionally, the game controller may be arranged to display targets together with an indication of the value of the target, and to pay out a prize of the indicated value when a hit is registered.

Many different types of target are possible. For example, the game controller may display additional targets, may record an additional target hit when a token hits a pin at the time an additional target is displayed on the screen directly behind the pin, and may take a predetermined action when the additional target hit is recorded.

Embodiments may further include a pusher apparatus including playfield and pusher at the base of the token passage to provide yet further gameplay.

For a better understanding of the invention, embodiments will now be described, purely by way of example, with reference to the accompanying drawings, in which.

Figure 1:
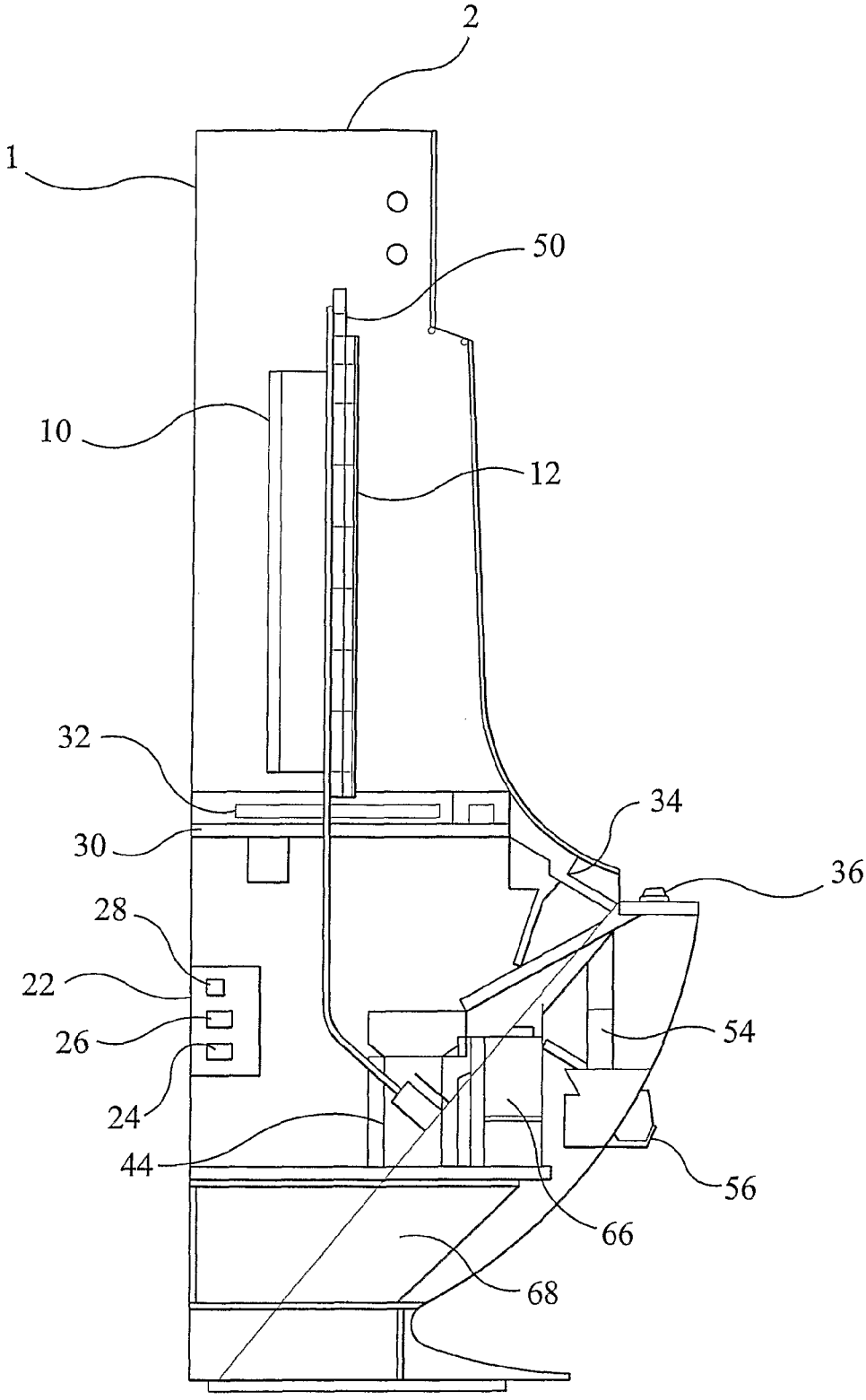
FIG. 1 is a side section through a games machine according to a first embodiment of the invention.
Figure 2:
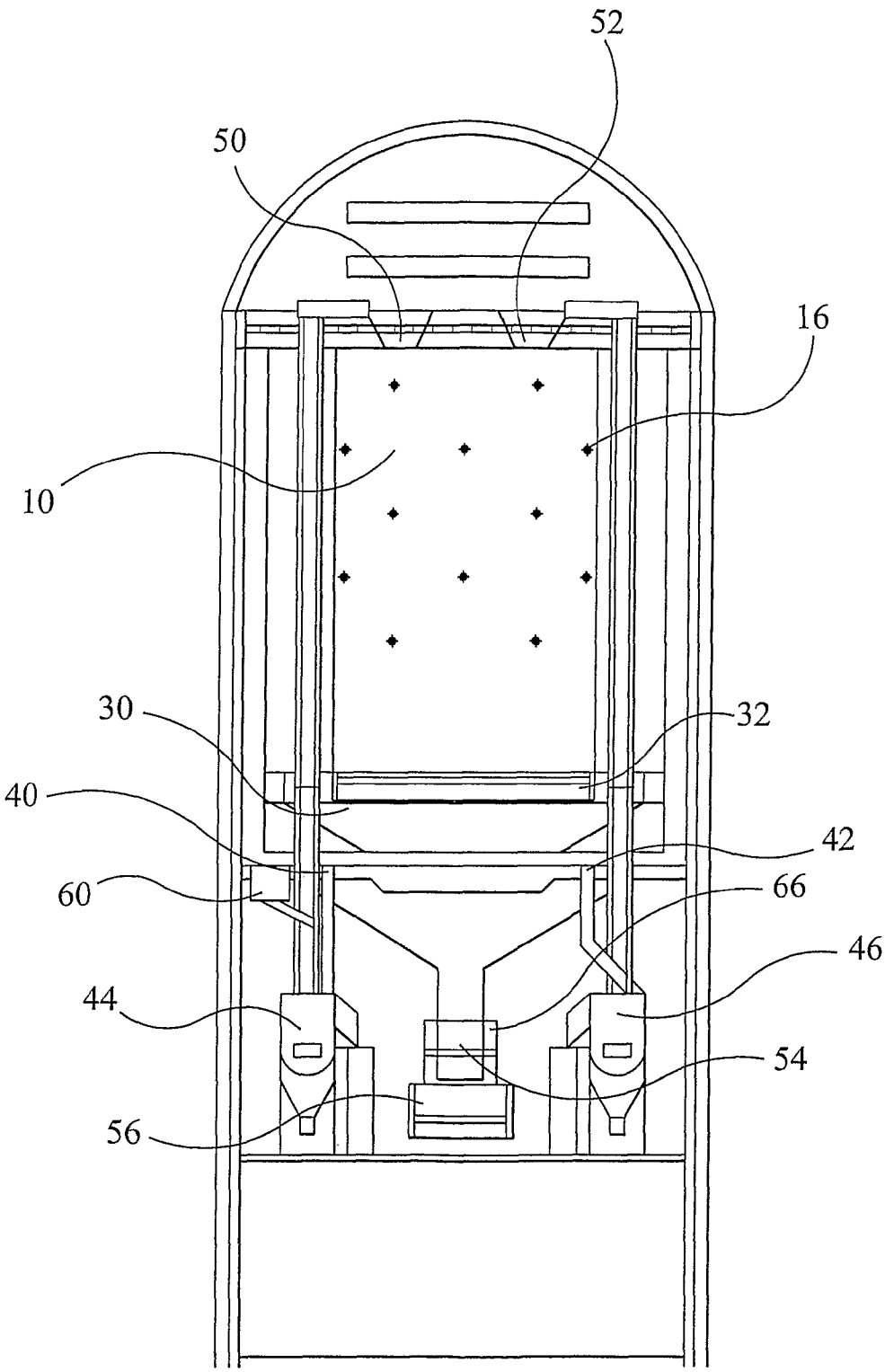
FIG. 2 is a front section through the games machine of FIG. 1.
Figure 3:
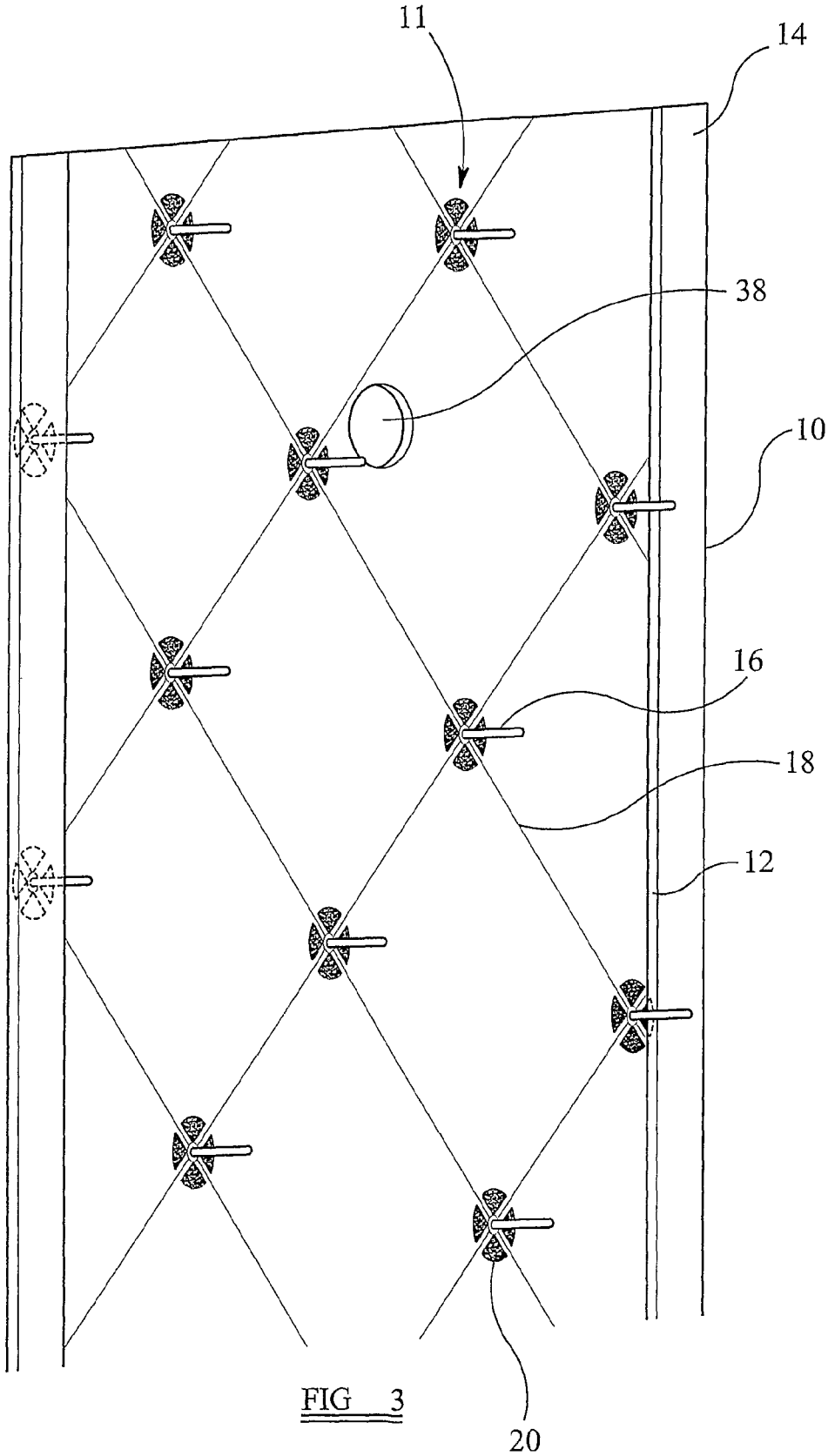
FIG. 3 is a perspective view of the token passage of the games machine of FIG. 1.

Referring to FIGS. 1 to 3, a games machine 1 has a housing 2 including a number of components.

At the front of the games machine 1 is provided a display screen 10 located behind a front panel 12 to define a token passage 14 between the display screen 10 and the front panel 12. In the embodiment, the display screen 10 is a flat panel liquid crystal display video screen, and the front panel 12 is of transparent perspex so that the display screen 10 can be viewed through the perspex. Other transparent materials may be used if required.

An array of pins 16 depend rearwardly from the front panel 12 through the token passage 14. A sensor 20 is provided on the front panel 12 at each pin 16 for sensing the presence of a token at the respective pin 16. A grid 18 of electrical connections is formed on the rear face of the front panel for connecting to the sensors 20. A single contiguous display is provided behind all the pins 16. The front panel 12 may be painted to hide the electrical connections of grid 18, for example by painting a pattern on the front of the front panel of the same form as grid 18.

The sensors and pins define fixed target regions around each pin; if the coin is in the target region the coin touches the pin and will cause the sensor to activate. In view of the importance of the target regions to the gameplay, they may be indicated by printing on the front panel 12, for example a printed circular region around the pin, or a cross, or other shape.

A number of different types of sensor may be used. For example, the sensor may be in the form of a vibration sensor that detects the impact of a token on the pin. Alternatively, an inductive sensor may be used that senses the presence of metal (i.e. the token) adjacent to the sensor.

A game controller 22 is provided in electrical connection to the display screen 10 as well as other components such as the grid 18. For clarity, these connections are not shown in the drawings. The game controller may be implemented using conventional computer components such as memory 24, a processor 26, and video display chip 28 in a number of known ways; the game controller will accordingly not be described in more detail.

A horizontal playfield 30 is provided below the token passage 14 so that tokens falling through the token passage land on the playfield. A pusher 32 is provided, arranged for reciprocal forward and back motion over the playfield. A win chute 34 at the front of the playfield is provided that communicates with a token pay out tray 36. In use, tokens on the play field may fall forward into the win chute 34 as a result of the reciprocal motion of the pusher, and these fall into the token pay out tray representing the player's winnings.

Lose chutes (not shown) may also be provided to allow tokens to fall from the playfield and divert them to the cashbox or hoppers as required.

A number of token handling mechanisms are provided. Two token slots 40, 42 are provided, a left token slot 40 and a right token slot 42. These are in communication with left escalator hopper 44 and right escalator hopper 46 respectively, so that tokens introduced into the left or right token slots 40, 42 are passed to the respective escalator hopper 44, 46. The escalator hoppers 44, 46 each include an escalator mechanism 48 for bring the tokens to respective left 50 and right 52 token entries at different positions at the top of the token passage 14. Thus, the introduction of a token into the left or right token slot 40, 42 causes a token to be introduced in the respective token entry.

Note that the escalator hopper may be arranged not to bring each token separately to the token entry, but to remain in an upper position adjacent to the token entry until the hopper is empty, only then returning to collect more tokens from below. Alternatively, a separate upper hopper may be provided to rapidly feed tokens into the token entries 50, 52.

Tokens entered into either left or right token slot 40, 42 are checked for validity and if rejected are passed through reject token chute 54 into pay cup 56.

Figure 4:
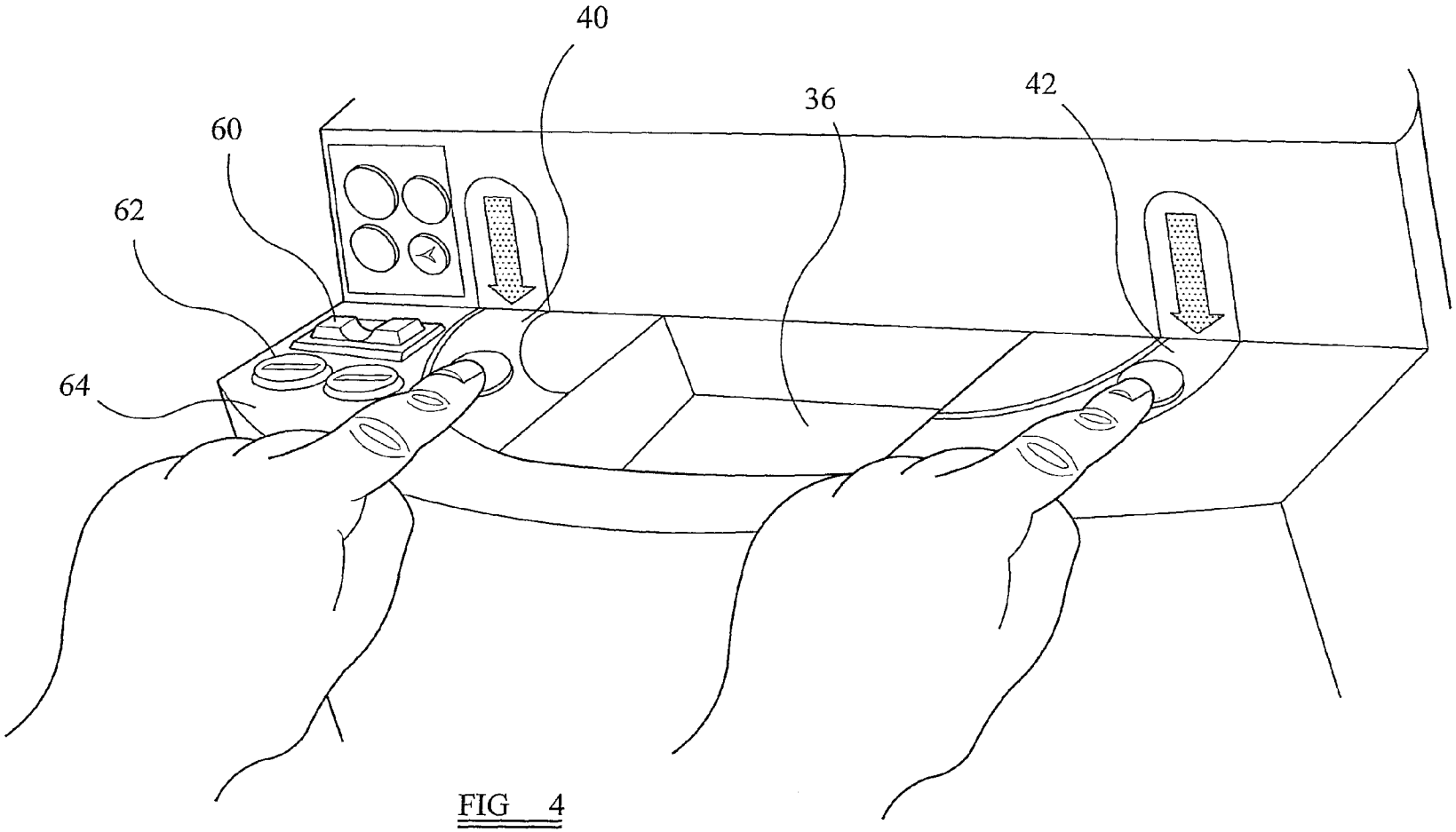
FIG. 4 illustrates the token entry mechanisms of the games machine of FIG. 1.

FIG. 4 illustrates token slots 40, 42 as well as token pay out tray 36.

A separate token mechanism 60 is provided for use with other values of tokens. For example, in the UK the mechanism may use 10p pieces, and the introduction of a 20p token into the token mechanism allows two tokens to be introduced without the need for the user to have change. Thus, entering tokens into the token mechanism provides the user with credit. If required, other means of payment for example using a payment card such as a credit or debit card may also be provided to allow users without appropriate change to use the machine.

A left button 62 and a right button 64 are provided to introduce a token through left or right token entry 50, 52 respectively if the user has credit. This allows the user to select the desired token entry and to time the introduction of the token.

A pay out mechanism 66 is also provided to pay out tokens into the pay cup 56 in the event of a win.

A cash box 68 is provided to store the takings of the machine.

In use, the game controller 22 is arranged to display a number of target objects 70 on the video display screen 10, each having a defined target area, referred to as a target for brevity. The image displayed may represent a target object 70 larger than the target. The use of a video display screen 10 means that the target objects can be arranged to move smoothly around the screen, not merely from pin 16 to pin 16 but continuously. As will be appreciated, the smooth motion will be represented by repeating frames with suitable motions of the targets between frames.

Figure 5:
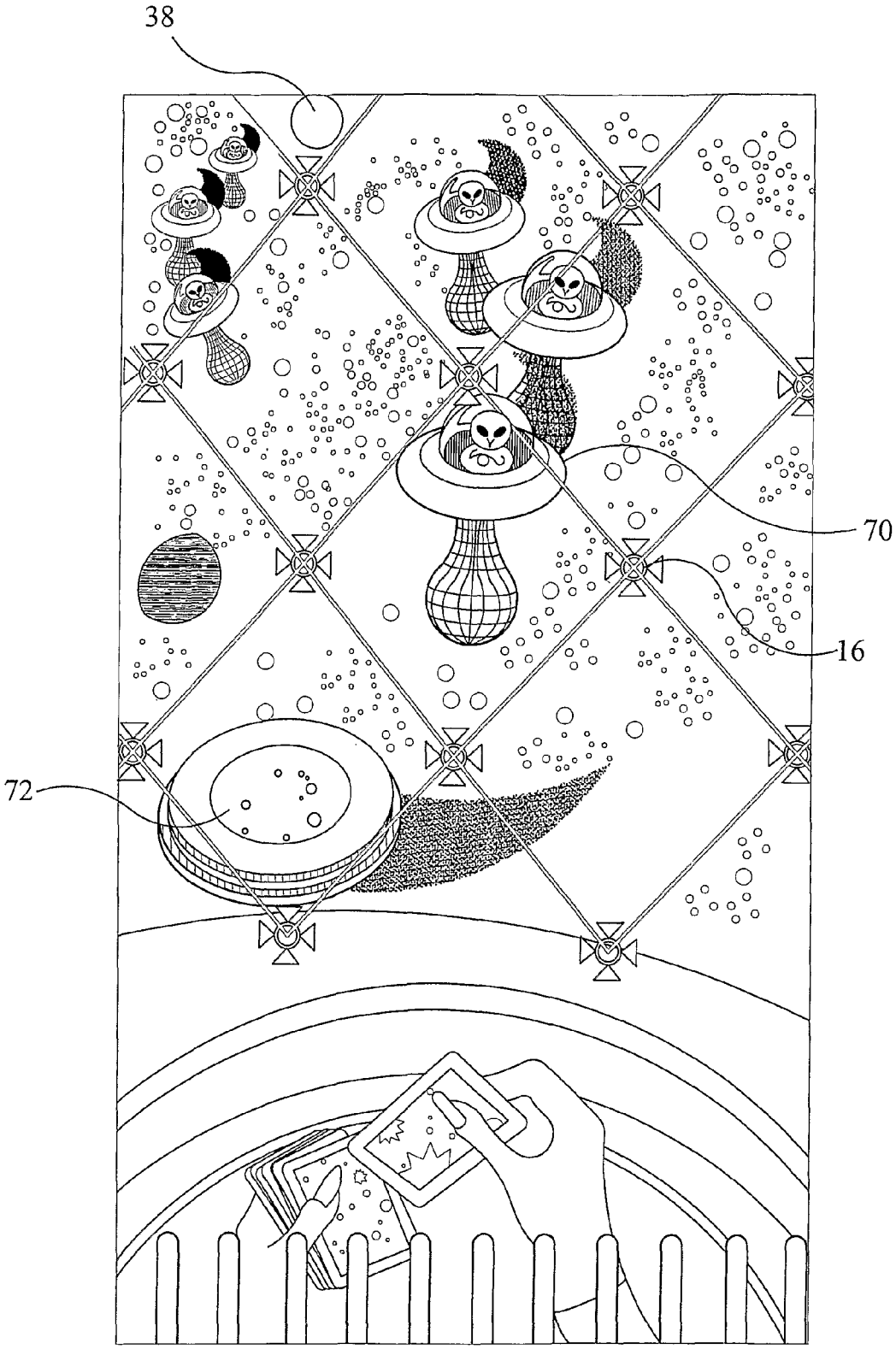
FIG. 5 is an example of a display on the games machine of FIG. 1.

A user can cause a token 38 to be inserted into the token passage 14 through either the left or right token entry 50, 52 either by inserting a suitable token into the respective token slot 40, 42 or by inserting tokens into the token mechanism to obtain a credit and then pressing the left or right button 60, 62 to cause a token to be inserted through the left or right token entry 50, 52 respectively. FIG. 5 illustrates a token 38 entering through the left token entry 50.

FIG. 5 illustrates a possible game play scenario with first target objects 70 that display a variable amount of money, paid out if the target is hit, and second, alternative, target objects 72 that cause a sub-game to be started when the alternative target is hit.

The token then falls, bouncing off the pins 16 as it does so. When the token hits a pin 16 the corresponding sensor 18 is triggered and a signal sent to the game controller 22. The game controller compares the location of the sensor 18 and hence the corresponding pin with the location of the target area on the video display screen. If the locations match, a "win" or "hit" is recorded.

It will be seen in this embodiment that the target objects are not presented as simple targets but as objects on the display screen that move around. Any object may be used as the target object. Note the distinction between target areas on the video screen and the fixed target regions 19, defined in this embodiment by the pin location. A hit occurs when the token hits the pin, i.e. hits the fixed target region 19, when this corresponds to a target area.

The action that the game controller takes in the event of a "hit" may vary. Indeed, there may be a number of targets of different types, with different effects. Depending on the target hit, one or more predetermined actions may be taken.

One type of target may be a simple target that when a "hit" is recorded, a cash value is paid out by pay out mechanism 66 into pay cup 68.

A second possible type of target is a target that can display a variable cash value, that changes over time. In this case, the cash value paid out by pay out mechanism 66 is determined by the displayed value.

A third possible type of target is a target that causes some other action, not simply a cash pay out, but to take some other action. For example, a sub-game may be started using the display screen. Alternatively, the action may be to change a displayed value on the screen and hence the size of a win in some cases, or to change the display to another form, or indeed any action as required by the gameplay. In FIG. 5, the "play 21s" target is of this type—hitting this target causes a sub-game to start—in this case the target is "21s", a blackjack type game.

By providing the additional gameplay made possible by the combination of video display screen 10 and pins 16 the interest for the player can be increased.

All of this functionality may be provided by simply programming the game controller 22 with a computer program that may be readily changed.

Some or all of the targets 70 may remain in one location for a period. The targets may appear, remain for a period of time, and then disappear.

The targets need not be continuously moving, but may pause briefly either under a pin or between pins. The motion of the targets may be predetermined or random, as required.

Figure 6:
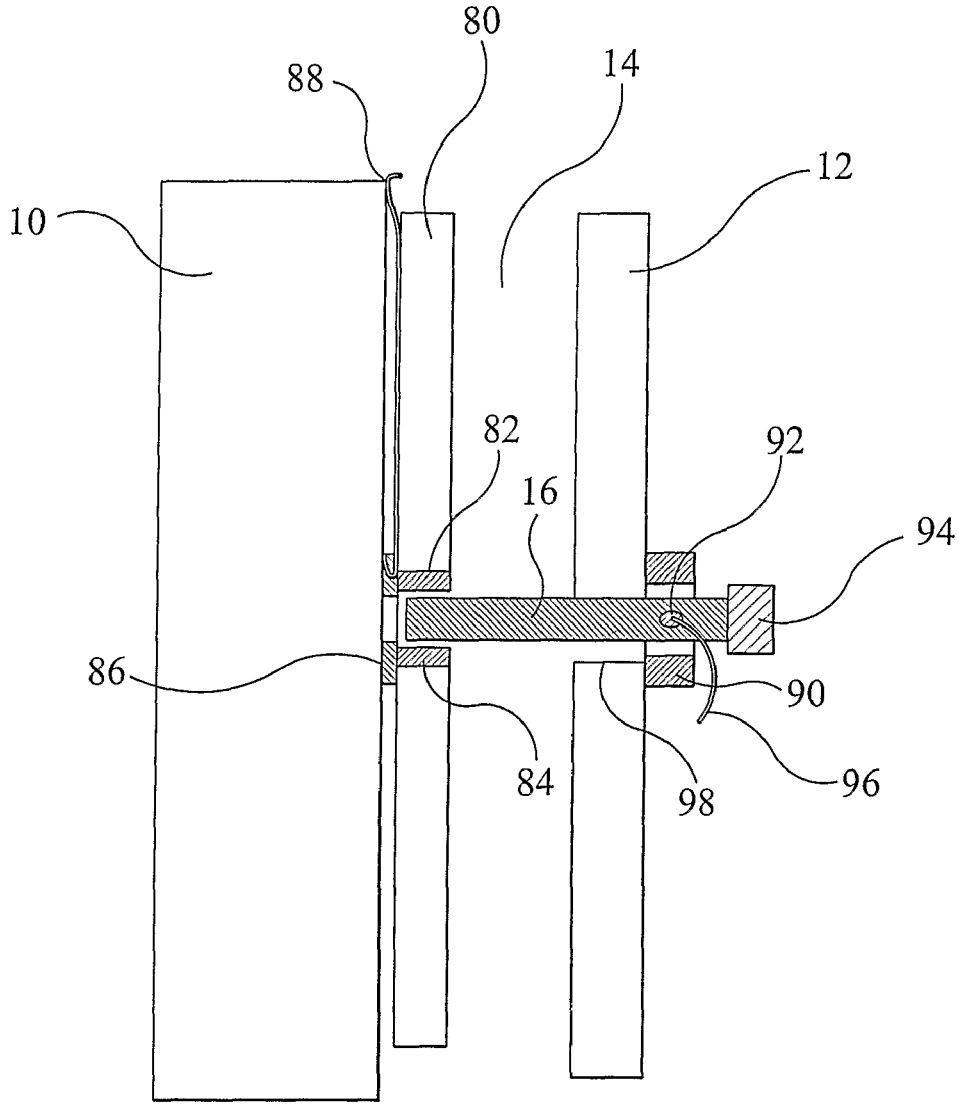
FIG. 6 is a side section of a particular pin arrangement of a second embodiment.

The second embodiment is the same as the embodiment of FIG. 1 except as shown in FIG. 6. A clear perspex back panel 80 is provided on the front of display panel 10. The back panel 10 includes a hole 82 at the pin location with a contact washer 84 in the hole and a brass contact ring 86 on the rear face of the back panel 80. An electrical connection 88 is provided to the brass contact ring 86.

The pin is mounted on the front panel 12 in mounting ring 90 which supports horizontal pivot 92 which in turn supports metallic pin 16. The pin 16 passes through slot 98 in the front panel 12. Another electrical connection 96 is connected to pivot 92 and so to pin 16. A counterweight 94 keeps the pin 16 in the position illustrated where the pin is spaced from the brass contact ring 86 so that there is no electrical connection between pin 16 and brass contact ring 86. When a coin or token impacts the pin it causes the pin 16 to pivot around the pivot 92 and contact the brass contact ring 86 and thereby make electrical connection.

This pin arrangement has proven particularly reliable in use.

Instead of the counterweight a small spring may be used instead.

Figure 7:
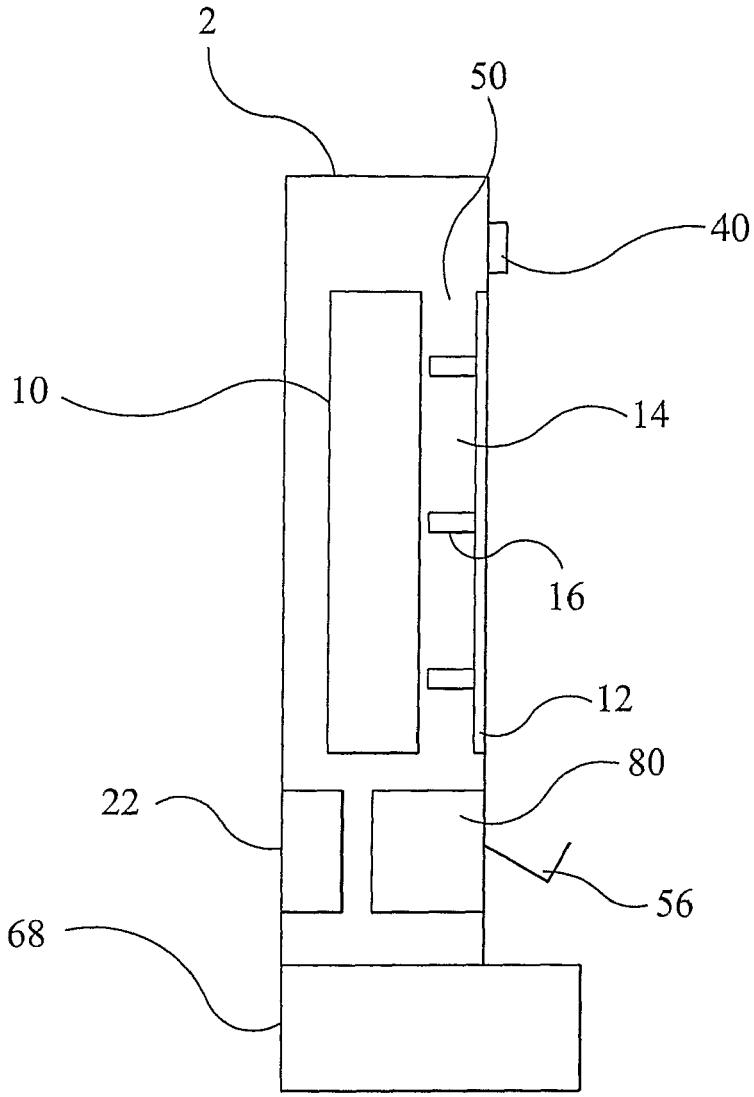
FIG. 7 is a side section of a games machine according to a third embodiment of the invention.

A third embodiment of the invention is illustrated in FIG. 7. The third embodiment is considerably simpler than the first. As in the first embodiment, there is a video display 10, front panel 12 and token passage 14, with pins 16 in the token passage 14 and the display 10 being controlled by game controller 22. A token entry 50 is provided at the top of the token passage, directly adjacent to respective token slot 40 and the user simply inserts a token in the token slot 40 so that it falls down through the respective token entry 50. The token slot 40 may be a simple coin entry or a more complex coin mechanism.

Although FIG. 7 only shows one token entry 50 and slot 40 since it is a side section there may of course be many more arranged across the top of the token passage, that is to say the top of the display. Embodiments may also include side entries if required.

Further, there is no pusher arrangement 30, 32 under the token passage 14 and tokens falling through fall directly into hopper 80. The hopper 80 has an overflow directly into cash box 68. In the event of a win, tokens are paid out from hopper 80 into pay cup 56.

As in the first embodiment, the game controller 22 generates targets 74 and the user in this case pays tokens in and aims to hit a pin when a target is behind the pin to result in a win.

Figure 8:
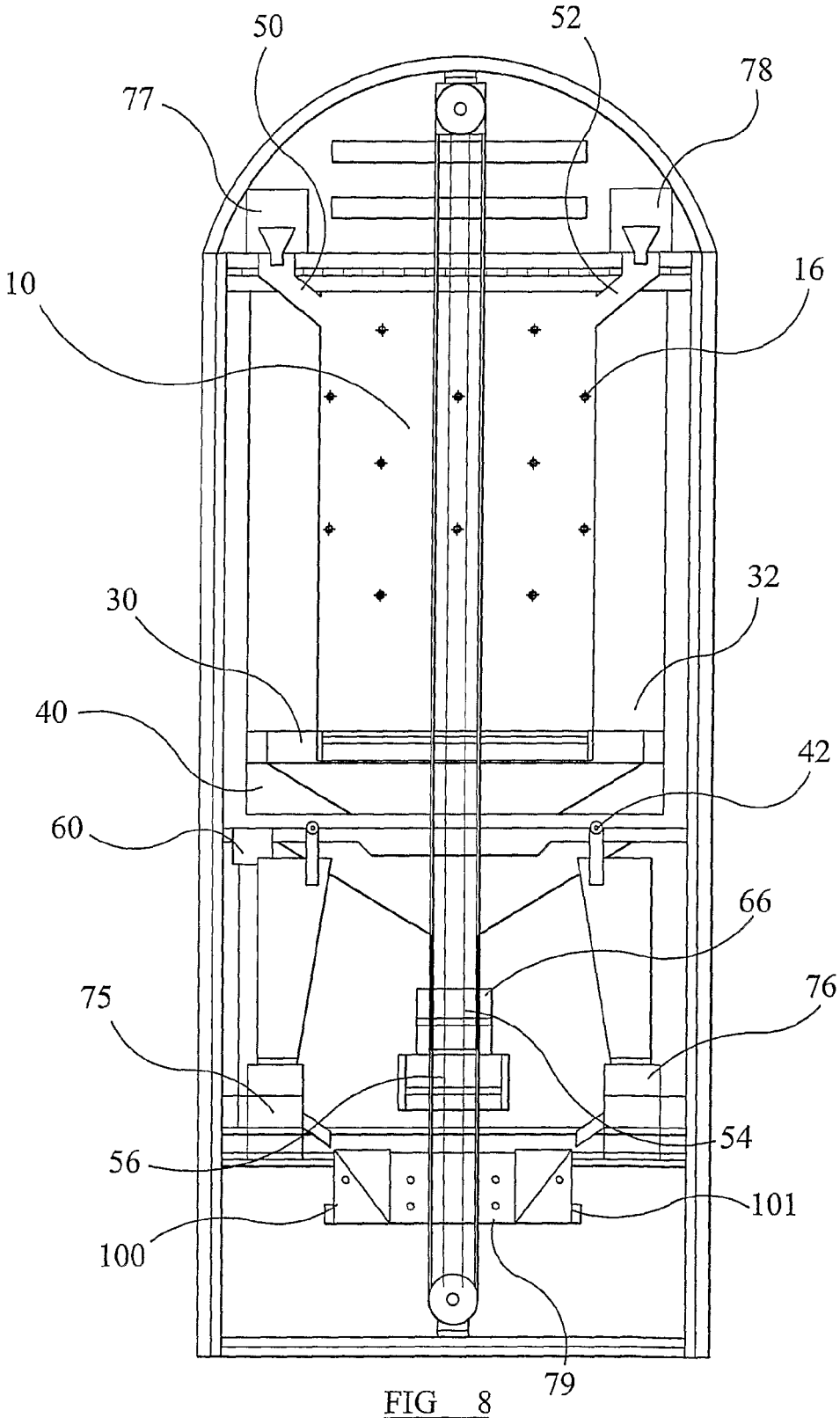
FIG. 8 is a front section of a games machine according to a fourth embodiment of the invention.

A fourth embodiment is illustrated in FIG. 8. In this embodiment, a bucket coin lift feed is used instead of the escalator hoppers 44, 46 described above.

Tokens inserted into the entry slots 40, 42 are fed into lower hoppers 75, 76 by chutes. Simultaneously, a token is released from one of the upper hoppers 77, 78 through respective left and right token passages 50, 52 to the play area.

A bucket coin lift assembly 79 is located behind the display and secured at the base of the machine. Each time a token is released from the upper hoppers to the play area, a token is issued from a lower hopper into corresponding bucket 80, 81. When a preset number of tokens is reached in a bucket, the bucket coin lift assembly is raised, tipped and emptied into the upper hoppers to replenish them to a known value. The buckets are then lowered to the lower hopper position for more tokens to be collected.

Aspects of the first to fifth embodiments may be combined as required, for example to include a pusher and top coin entry, or the more complex coin handling mechanisms of the first embodiment with the simple display without pusher of the second. Those skilled in the art will realise that many other combinations exist.

Further, those skilled in the art will realise that the invention may incorporate alterations and substitutions to the described components. For example, alternative coin entry mechanisms may be used, including a coin mechanism of the type where a user holds a vertical stack of coins in a vertical recess in the front panel of the machine, having an entry slot at the upper end of the recess, and coins are entered by being fed forward into the entry slot.

Alternative video display technologies may be used.

Further, alternative means for detecting a token in a fixed target region 19 may be used.

In particular, optical sensors may be used to detect when a token is present in the fixed target region 19. This delivers the advantage that the location of the target region does not have to be at the same location as the pin. The optical sensors can be provided at or around each pin to detect a coin hitting the pin. The optical sensors may alternatively or additionally be provided at other locations. However, the embodiments discussed above using mechanical sensors are presently preferred since it is more difficult to achieve absolute reliability using optical sensors than when using mechanical sensors.

The invention claimed is:

1. A games machine, comprising:

a video display screen (10);

a transparent front screen spaced from the video display screen (12) and substantially parallel with the video display screen defining a token passage between the transparent front screen and the video display screen;

a token inlet (50) at the top of the token passage for introducing tokens so that they can fall under gravity through the token passage; and a plurality of pins (16) extending in the token passage to deflect tokens passing through the token passage;

wherein the games machine is arranged to display one or more targets (74) on the video display screen, the display of targets not being constant over time, and to record a hit when a token hits a pin at the time a target is displayed on the screen behind the pin.

2. A games machine according to claim 1 further comprising a game controller (22), the game controller being arranged to drive the video display screen (10) with changing images including the one or more targets (74), to receive signals from the pins (16) indicating when the pins have been hit, and to register a hit when a token hits a pin at the time a target is displayed on the screen directly behind the pin.

3. A games machine according to claim 2 wherein the game controller (22) is arranged to move at least one target (74) smoothly over the video display screen (10) with time.

4. A games machine according to claim 2, wherein the game controller (22) is arranged to display targets (74) together with an indication of the value of the target, and to pay out a prize of the indicated value when a hit is registered.

5. A games machine according to claim 2, wherein the game controller (22) is arranged to display a plurality of types of targets (74), and to take a respective predetermined action depending on the type of target hit when a target hit is recorded.

6. A games machine according to claim 1, wherein a single contiguous display screen (10) is arranged behind all of the plurality of pins in the token passage.

7. A games machine according to claim 1, further comprising a pivot (92) supported on the transparent front screen (12) about which each pin (16) can rotate, and each pin extending through a contact ring (84) on the other side of the token passage to the transparent front screen, wherein the pin (16) is biased to a first position spaced from the contact ring until a coin hits the pin causing the pin to pivot and contact the contact ring.

8. A games machine according to claim 7, wherein each pin has a counterweight (94) in front of the pivot arranged to bias the pin to the first position spaced from the contact ring.

9. A games machine according to claim 1, further comprising a conductive grid pattern on the transparent front screen connecting to the pins.

10. A games machine according to claim 1 further comprising a token entry for inputting tokens into the games machine and a pay cup for paying out one or more tokens in the event of a hit.

11. A games machine according to claim 1, having a plurality of token inlets at the top of the token passage and a means for selecting through which token inlet a token is introduced into the token passage.

12. A games machine according to claim 1 further comprising a horizontal play field at the bottom of the token passage, arranged so that tokens passing through the token passage can land on the play field; a win chute adjacent to the horizontal play field arranged such that tokens passing into the win chute result in a win; and a pusher arranged for reciprocating motion over the playfield.

13. A games machine, comprising:

a video display screen (10);

a transparent front screen spaced from the video display screen (12) and substantially parallel with the video display screen defining a token passage between the transparent front screen and the video display screen;

a token inlet (50) at the top of the token passage for introducing tokens so that they can fall under gravity through the token passage; and a plurality of pins (16) extending in the token passage to deflect tokens passing through the token passage;

a plurality of fixed target regions (19);

further comprising a game controller arranged to display one or more targets (74) on the video display screen, the display of targets not being constant over time, and to record a hit when a token hits a fixed target region (19) at the time a target (74) is displayed on the screen at the fixed target regions (19).

14. A games machine according to claim 13 wherein the game controller (22) is arranged to display a plurality of types of targets (74), and to take a respective predetermined action depending on the type of target hit when a target hit is recorded.

* * * * *